US008454011B2

(12) United States Patent
Tanaka et al.

(10) Patent No.: US 8,454,011 B2
(45) Date of Patent: Jun. 4, 2013

(54) SHEET FEEDER AND IMAGE FORMING APPARATUS INCORPORATING SAME

(75) Inventors: Mizuna Tanaka, Osaka (JP); Tatsuo Fukushima, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/278,205

(22) Filed: Oct. 21, 2011

(65) Prior Publication Data

US 2012/0104690 A1 May 3, 2012

(30) Foreign Application Priority Data

Nov. 1, 2010 (JP) ..... 2010-245287

(51) Int. Cl.
*B65H 9/14* (2006.01)

(52) U.S. Cl.
USPC ..... 271/229; 271/242; 271/265.01

(58) Field of Classification Search
USPC ..... 271/10.01, 10.03, 256, 258.01, 227, 271/229, 242
See application file for complete search history.

(56) References Cited

U.S. PATENT DOCUMENTS

| | | | | |
|---|---|---|---|---|
| 7,334,787 | B2 * | 2/2008 | Akiyama et al. | 271/10.02 |
| 7,871,068 | B2 * | 1/2011 | Yamazaki | 271/10.03 |
| 7,883,083 | B2 * | 2/2011 | Fukasawa | 271/10.03 |
| 8,042,806 | B2 * | 10/2011 | Ubayashi | 271/229 |
| 8,047,529 | B2 * | 11/2011 | Fukasawa | 271/10.03 |
| 8,070,152 | B2 * | 12/2011 | Miwa et al. | 271/10.03 |
| 8,152,164 | B2 * | 4/2012 | Yamamoto et al. | 271/242 |
| 2003/0085505 | A1 * | 5/2003 | Inoue et al. | 271/10.01 |
| 2003/0146566 | A1 * | 8/2003 | Aizawa | 271/242 |
| 2009/0057984 | A1 * | 3/2009 | Matsumoto | 271/10.03 |
| 2010/0044950 | A1 * | 2/2010 | Katsura et al. | 271/10.03 |
| 2011/0291353 | A1 * | 12/2011 | Fujiwara et al. | 271/258.01 |

FOREIGN PATENT DOCUMENTS

| | | | |
|---|---|---|---|
| JP | 62175359 | A | 8/1987 |
| JP | 4133070 | A | 5/1992 |
| JP | 0986729 | A | 3/1997 |
| JP | 10254202 | A | 9/1998 |
| JP | 2003155147 | A | 5/2003 |

OTHER PUBLICATIONS

Abstract of JP 62-175359 published Aug. 1, 1987.
Abstract of JP 09-086729 published Mar. 31, 1997.
Abstract of JP 2003-155147 published May 27, 2003.
Abstract of JP 4133070 published May 7, 1992.
Abstract of JP 10-254202 published Sep. 25, 1998.

* cited by examiner

*Primary Examiner* — Kaitlin Joerger
(74) *Attorney, Agent, or Firm* — Harness, Dickey & Pierce, P.L.C.

(57) ABSTRACT

A sheet feeder incorporatable in an image forming apparatus includes a sheet container to accommodate a sheet, a sheet feeding unit, a sheet conveyance member, a sheet conveying unit disposed downstream from the sheet feeding member in a sheet conveyance direction, and a controller to stop the sheet feeding unit before the sheet abuts against the sheet conveying unit and to resume the driving, and to drive the sheet conveying unit to start while rotating the sheet feeding unit. The controller adjusts a temporary stop period for the driving of the sheet feeding unit before the sheet abuts against the sheet conveying unit, according to a period in which the sheet passes first and second points determined optionally between a standby position determined prior to feeding of the sheet and a temporary stop position located before the sheet abuts against the sheet conveying unit.

26 Claims, 7 Drawing Sheets

SHEET FEEDER AND IMAGE FORMING APPARATUS INCORPORATING SAME

CROSS-REFERENCE TO RELATED APPLICATIONS

This patent application is based on and claims priority pursuant to 35 U.S.C. §119 from Japanese Patent Application No. 2010-245287, filed on Nov. 1, 2010 in the Japan Patent Office, the entire disclosure of which is hereby incorporated herein by reference.

FIELD OF THE INVENTION

Embodiments of the present invention relate to a sheet feeder to feed and convey a sheet of paper forward, and an image faulting apparatus incorporating the sheet feeder.

BACKGROUND OF THE INVENTION

Related-art image forming apparatuses such as copiers, printers, facsimile machines, and multifunctional machines including at least two of these functions generally employ a pair of registration rollers that serves as a sheet correction unit to correct skew of a sheet of paper before an image formed on an image carrier is transferred onto the sheet of paper.

FIG. 1 illustrates a schematic configuration of a related-art sheet feeder including a pair of registration rollers therein.

In the configuration of the related-art sheet feeder, here employing a pair of registration rollers 300 as illustrated in FIG. 1, a leading edge of a sheet of paper S conveyed by a sheet feed roller 200 in a direction indicated by arrow "Y" in FIG. 1 is abutted against a nip contact area of the pair of registration rollers 300, which remains stopped, thereby deflecting the sheet S a given amount and generating a restorative force. Then, the restorative force causes the leading edge of the sheet S to be aligned along the nip contact area, thereby correcting skew of the sheet S. Thereafter, in synchronization with transport of an image is transferred onto an image transfer member, the sheet feed roller 200 and the pair of registration rollers 300 are driven to convey the sheet S further forward. The above-described operation is generally used to achieve an uncomplicated and low-cost configuration. A drawback of this arrangement, however, is that when the sheet feed roller 200 is stopped after the sheet S has been deflected, impact noise is generated.

As illustrated in FIG. 1, a sheet separation member 500 is provided at the position facing the sheet feed roller 200 to separate the sheet S one by one. The sheet separation member 500 is supported or held by a holder 600 and biased by a biasing member 700 toward the sheet feed roller 200. While the movement of the holder 600 in a direction parallel to a sheet conveyance direction is restricted by a positioning member 800, the movement in a direction toward an axial center of the sheet feed roller 200, that is, in a direction substantially perpendicular to the sheet conveyance direction is free and not regulated. A more detailed description of this arrangement follows.

FIG. 2 is an enlarged cross-sectional view illustrating the positioning member 800 and components around the positioning member 800.

As illustrated in FIG. 2, the positioning member 800 is inserted into and slidably move along a groove 900 provided in a sheet feed tray 400. With this configuration, the positioning member 800 is allowed to move in a direction substantially perpendicular to the sheet conveyance direction (as indicated by arrow "X" in FIG. 2) but is restricted from moving in a direction parallel to the sheet conveyance direction (as indicated by arrow "Y" in FIG. 2). Strictly speaking, however, in order to assure the slidable movement of the positioning member 800 both in the sheet conveyance direction and in the direction substantially perpendicular to the sheet conveyance direction, a small gap G is provided between the positioning member 800 and the walls of the groove 900 to form clearance in the sheet conveyance direction.

If such space is formed between the positioning member 800 and the groove 900, when the driving of the sheet feed roller 200 is stopped with the sheet S deflected, the sheet feed roller 200 rotates a slight amount in reverse in response to the restorative force F caused by the deflection of the sheet S described above. Due to this action, the holder 600 receives a force that is exerted to an upward side in the sheet conveyance direction. Then, the positioning member 800 abuts against the groove 900, which causes impact noise.

In order to avoid the impact noise caused by the abutment of the positioning member 800 against the groove 900, the sheet feed roller 200 and the pair of registration rollers 300 can have separate drive sources so that the sheet feed roller 200 can be prevented from rotating in reverse. However, the addition of another drive source increases the size and cost of the image forming apparatus, and therefore the sheet feeder cannot be implemented in a low-cost image forming apparatus.

In order to avoid the above-described problem without adding another drive source, Japanese Patent Application Publication No. 04-133070-A proposes an arrangement in which the driving of the sheet feed roller is temporarily stopped before the leading edge of a sheet conveyed by the sheet feed roller is abutted against the pair of registration rollers, after which the sheet feed roller is again driven. There, the leading edge of the sheet is deflected, and at the same time the pair of registration rollers is driven to rotate with the sheet feed roller being rotated so as to convey the sheet. Thus, by rotating the sheet feed roller continuously without stopping after the deflection thereof is formed, the reverse rotation of the sheet feed roller due to the restorative force generated by the deflection of the sheet can be avoided, thereby preventing occurrence of impact noise caused by the movement of the positioning member.

Although the method described in Japanese Patent Application Publication No. 04-133070-A can eliminate the impact noise caused by the positioning member after the deflection of the sheet is formed, another problem can arise because of the above-described solution. In a related-art control of skew prevention, the driving of the sheet feed roller is temporarily stopped with the sheet remaining in contact with the pair of registration rollers, and therefore the leading edge of the sheet is aligned accurately. By contrast, in the method disclosed in Japanese Patent Application Publication No. 04-0133070-A, the driving of the sheet feed roller is stopped before the sheet contacts the pair of registration rollers. Therefore, due to rigidity of the sheet and variation of the coefficient of friction, adhesion of paper dust to the sheet feed roller or a separation member, aging of the sheet feed roller and the separation member and the like, slippage occurring when the sheet is fed from the sheet tray causes the position where the sheet is stopped before the pair of registration rollers to vary.

For example, when the leading edge of the sheet is stopped at an upstream side from a predetermined position in a sheet conveyance direction due to slipping of the sheet, it is likely that the pair of registration rollers starts driving before the sheet contacts the pair of registration rollers. This can fail in deflecting the sheet, which can vary the position of the leading edge of the sheet and/or cause accurate skew correction to fail.

In order to prevent failure in deflecting the sheet, a greater deflection can be given to the sheet that takes such slippage into consideration. However, since greater deflection generates greater restorative force, if there is no space for the deflection of the sheet in a sheet conveyance pathway, it is likely that the leading edge of the sheet exceeds a nip contact area formed by the pair of registration rollers, again generating variation in the position of the leading edge of the sheet.

BRIEF SUMMARY OF THE INVENTION

The present invention describes a sheet feeder and an image forming apparatus incorporating the sheet feeder. In one example, a novel sheet feeder for an image forming apparatus includes a sheet container to accommodate a sheet, a sheet feeding unit to feed the sheet contained in the sheet container, a sheet conveying unit disposed downstream from the sheet feeding unit in a sheet conveyance direction, and a controller to cause the sheet feeding unit to stop driving before the leading edge of the sheet that is fed by the sheet feeding unit abuts against the sheet conveying unit, and to cause the sheet conveying unit to start driving while the sheet feeding unit is being driven to convey the sheet further forward. The controller varies a temporary stop period to temporarily stop the driving of the sheet feeding unit before the leading edge of the sheet abuts against the sheet conveying unit according to a period in which the sheet passes a first point and a second point between a standby position that is determined prior to feeding of the sheet and a temporary stop position at which the sheet is stopped before the sheet abuts against the sheet conveying unit.

The controller may determine the temporary stop period of the sheet feeding unit according to a correction coefficient that is a ratio of an actual length of time at which the sheet passes the first point and the second point to an estimated length of time at which the sheet passes the first point and the second point.

When the correction coefficient is greater than a predetermined upper limit, the controller may determine the temporary stop period of the sheet feeding unit based on the upper limit.

When the correction coefficient is smaller than a predetermined lower limit, the controller may determine the temporary stop period of the sheet feeding unit based on the lower limit The controller may determine the temporary stop period of the sheet feeding unit according to the correction coefficient and a sheet feed speed of the sheet feeding unit.

The controller may determine a driving resume period of the sheet feeding unit according to the correction coefficient and a sheet type.

The above-described sheet feeder may further include a detector to detect a leading edge of the sheet on a sheet conveyance pathway defined between the sheet feeding unit and the sheet conveying unit. The first point may be a position at which the leading edge of the sheet is located at the standby position prior to the sheet feeding and the second point is a position at which the detector detects the leading edge of the sheet.

The controller may determine the temporary stop period of the sheet feeding unit according to a correction coefficient that indicates a ratio of an actual length of time in which the sheet departs from a standby position prior to the sheet feeding and arrives at a detection position of the leading edge of the sheet, to a calculated length of time in which the sheet departs from the standby position prior to the sheet feeding and arrives at the detection position of the leading edge of the sheet. The controller may modify the calculated length of time according to position when the sheet is fed from a position different from the predetermined standby position prior to the sheet feeding.

The above-described sheet feeder may further include a first detector to detect a leading edge of the sheet on a sheet conveyance pathway defined between the sheet feeding unit and the sheet conveying unit, and a second detector to detect the leading edge of the sheet at a position downstream from the first detector in the sheet conveyance direction on the sheet conveyance pathway. The first point may be a position at which the first detector detects the leading edge of the sheet and the second point may be a position at which the second detector detects the leading edge of the sheet.

In another example, a novel image forming apparatus includes an image forming device to form an image on an image carrier and the above-described sheet feeder.

In another example, a novel sheet feeder includes a sheet container to accommodate a sheet, a sheet feeding unit to feed the sheet contained in the sheet container, a sheet conveying unit disposed downstream from the sheet feeding unit in a sheet conveyance direction, and a controller to cause the sheet feeding unit to stop driving before the leading edge of the sheet that is fed by the sheet feeding unit abuts against the sheet conveying unit and to resume the driving to abut the leading edge of the sheet against the sheet conveying unit, and to cause the sheet conveying unit to start driving while the sheet feeding unit is being driven to convey the sheet further forward. The controller varies a temporary stop period to temporarily stop the driving of the sheet feeding unit before the leading edge of the sheet abuts against the sheet conveying unit and a driving resume period to resume the driving of the sheet feeding unit after the temporary stop period, according to a period in which the sheet passes a first point and a second point between a standby position that is determined prior to feeding of the sheet and a temporary stop position that is located before the sheet abuts against the sheet conveying unit.

The controller may determine the temporary stop period of the sheet feeding unit and the driving resume period of the sheet feeding unit according to a correction coefficient that is a ratio of an actual length of time at which the sheet passes the first point and the second point to a calculated length of time at which the sheet passes the first point and the second point.

When the correction coefficient is greater than a predetermined upper limit of the correction coefficient, the controller may determine the temporary stop period of the sheet feeding unit and the driving resume period of the sheet feeding unit based on the upper limit.

When the correction coefficient is smaller than a predetermined lower limit, the controller may determine the temporary stop period of the sheet feeding unit and the driving resume period of the sheet feeding unit based on the lower limit.

The controller may determine the temporary stop period of the sheet feeding unit and the driving resume period of the sheet feeding unit according to the correction coefficient and a sheet feed speed of the sheet feeding unit.

The controller may determine the driving resume period of the sheet feeding unit according to the correction coefficient and a sheet type.

The above-described sheet feeder may further include a detector to detect a leading edge of the sheet on a sheet conveyance pathway defined between the sheet feeding unit and the sheet conveying unit, wherein the first point is a position at which the leading edge of the sheet is located at the standby position prior to the sheet feeding and the second point is a position at which the detector detects the leading edge of the sheet.

The controller may determine the temporary stop period of the sheet feeding unit and the driving resume period of the sheet feeding unit according to a correction coefficient that indicates a ratio of an actual length of time in which the sheet departs from a standby position prior to the sheet feeding and arrives at a detection position of the leading edge of the sheet to a theoretical length of time in which the sheet departs from a standby position prior to the sheet feeding and arrives at a detection position of the leading edge of the sheet. The controller may modify the theoretical length of time according to the position when the sheet is fed from a position different from the predetermined standby position prior to the sheet feeding.

The above-described sheet feeder may further include a first detector to detect a leading edge of the sheet on a sheet conveyance pathway defined between the sheet feeding unit and the sheet conveying unit, and a second detector to detect the leading edge of the sheet at a position downstream from the first detector in a sheet conveyance direction on the sheet conveyance pathway. The first point may be a position at which the first detector detects the leading edge of the sheet and the second point is a position at which the second detector detects the leading edge of the sheet.

In another example, a novel image forming apparatus includes an image forming device to form an image on an image carrier, and the above-described sheet feeder.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
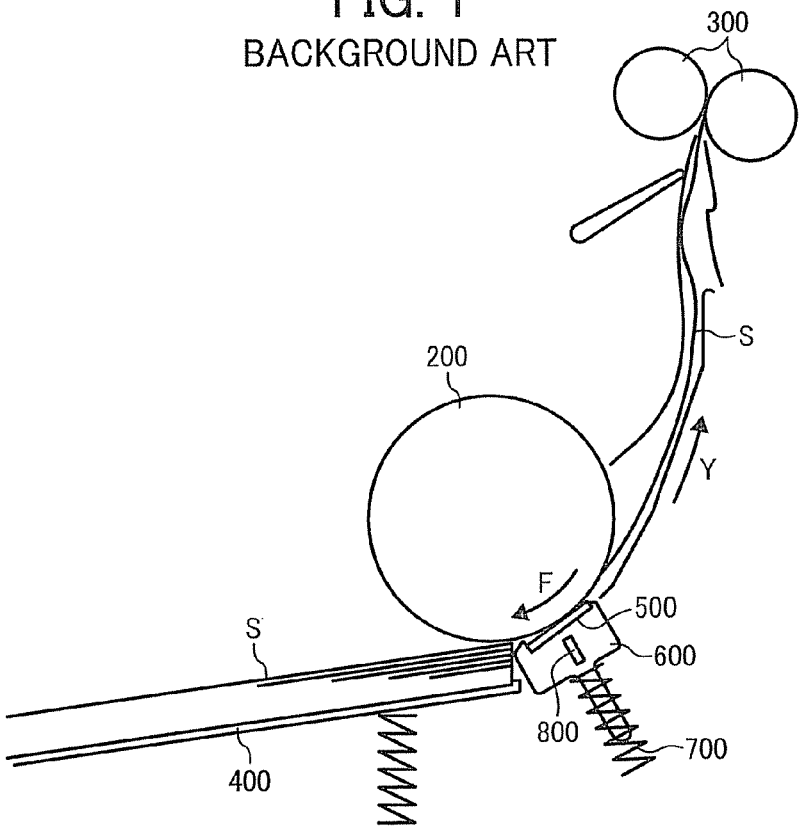
FIG. 1 BACKGROUND ART
FIG. 1 is a schematic configuration of a related-art sheet feeder.
Figure 2:
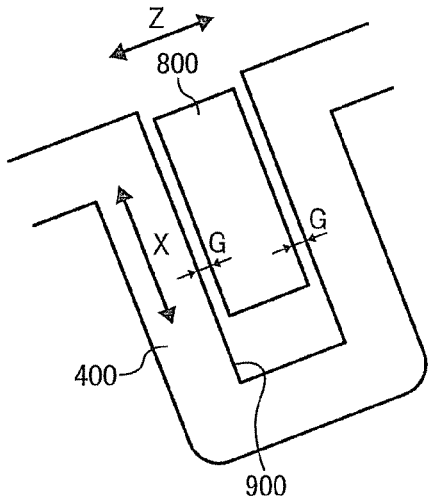
FIG. 2 BACKGROUND ART
FIG. 2 is an enlarged cross-sectional view of a positioning unit of the related-art sheet feeder of FIG. 1.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image foaming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

[Embodiment 1]

Figure 3:
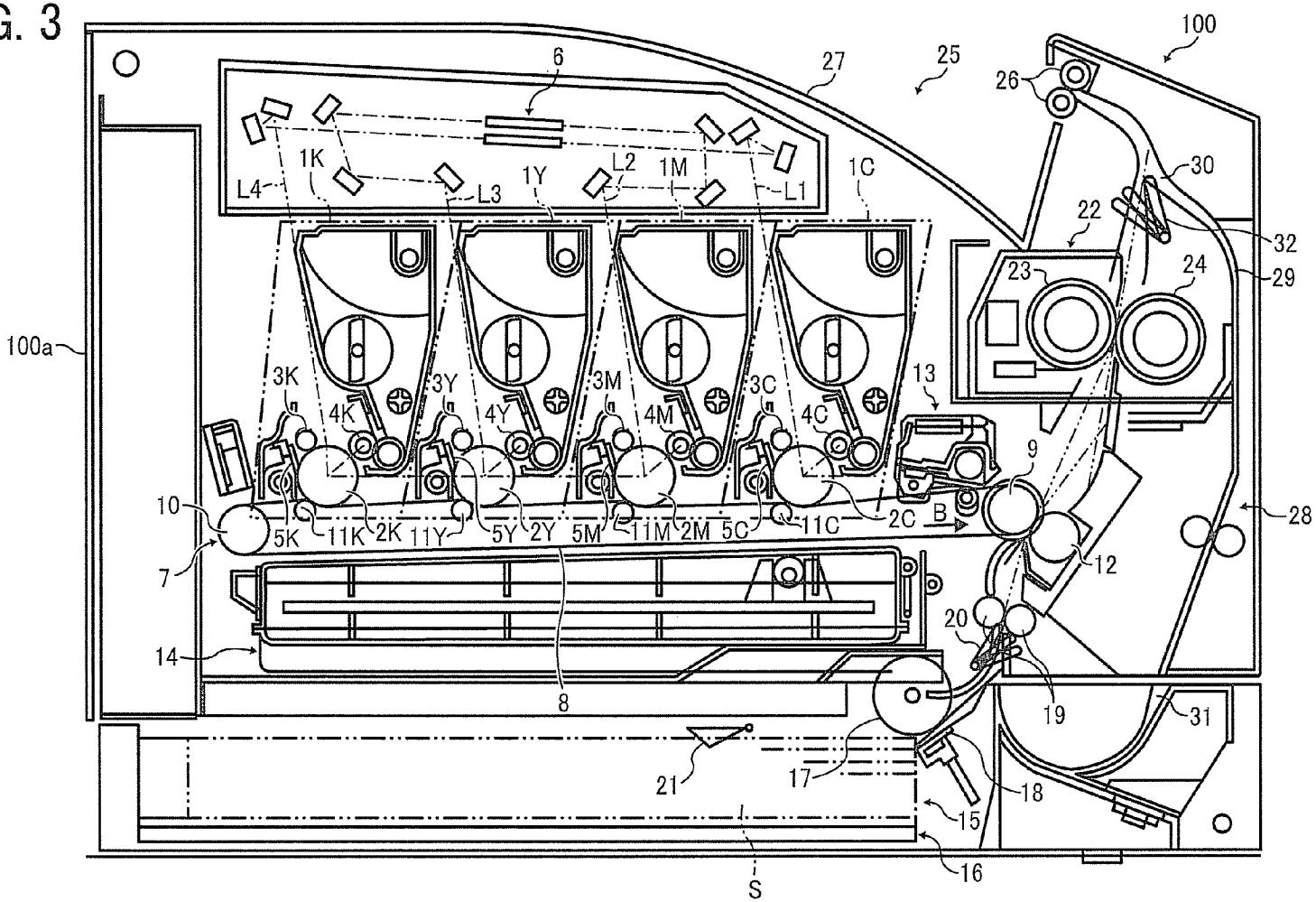
FIG. 3 is a schematic configuration of an image forming apparatus according to Embodiment 1 of the present invention, incorporating a sheet feeder according to Embodiment 1 of the present invention.

FIG. 3 is a schematic configuration of an image forming apparatus 100 according to Embodiment 1 of the present invention, incorporating a sheet feeder 15 according to Embodiment 1 of the present invention.

As illustrated in FIG. 3, the image forming apparatus 100 functions as a color laser printer includes a main body 100*a* and the sheet feeder 15.

The main body 100*a* includes an image forming unit composed of four process units 1C, 1M, 1Y, and 1K. The process units 1C, 1M, 1Y, and 1K are removably installable in the image forming apparatus 100. Elements and functions of the process units 1C, 1M, 1Y, and 1K are similar to each other, except for containing different colors of toners corresponding to respective color separation elements of a color image, for example, cyan (C) toner, magenta (M) toner, yellow (Y) toner, and black (K) toner.

Specifically, each process unit 1 (i.e., the process units 1C, 1M, 1Y, and 1K) includes a drum-shaped photoconductor 2 (i.e., drum-shaped photoconductors 2C, 2M, 2Y, and 2K) serving as an image carrier, a charging unit including a charging roller 3 (i.e., charging rollers 3C, 3M, 3Y, and 3K) to uniformly charge a surface of the drum-shaped photoconductor 2, a developing unit including a developing roller 4 (i.e., developing rollers 4C, 4M, 4Y, and 4K) to supply toner (developer) to the surface of the drum-shaped photoconductor 2, a cleaning unit including a cleaning blade 5 (i.e., cleaning blades 5C, 5M, 5Y, and 5K) to clean the surface of the drum-shaped photoconductor 2, and so forth.

In FIG. 3, an optical writing device 6 that serves as an exposure device is disposed above the process units 1C, 1M, 1Y, and 1K to irradiate the surface of the drum-shaped photoconductor 2. The optical writing device 6 includes a light source, a polygon mirror, fθ (f-theta) lenses, reflection lenses, and so forth to emit respective a laser light beam L (i.e., laser light beams L1, L2, L3, and L4) toward the surface of the drum-shaped photoconductor 2 according to image data.

Further, a transfer device 7 is disposed below the process units 1C, 1M, 1Y, and 1K. The transfer unit 7 includes an intermediate transfer belt 8 in an endless shape that serves as a transfer member. The intermediate transfer belt 8 is wound around and extended by a drive roller 9 and a driven roller 10, both of which serve as supporting members. As the drive roller 9 rotates in a counterclockwise direction in FIG. 3, the intermediate transfer belt 8 formed in an endless loop rotates in a direction indicated by arrow B in FIG. 3. Hereinafter, the direction indicated by arrow B is referred to as a direction B.

Four primary transfer rollers 11C, 11M, 11Y, and 11K, each of which serving as a primary transfer member, are disposed facing the photoconductors 2C, 2M, 2Y, and 2K, respectively. The primary transfer rollers 11C, 11M, 11Y, and 11K press contact an inner surface of the intermediate transfer belt 8 at which the primary transfer rollers 11C, 11M, 11Y, and 11K face the photoconductors 2C, 2M, 2Y, and 2K, respectively, to form respective primary nip contact areas therebetween. Each of the primary transfer rollers 11C, 11M, 11Y, and 11K is connected to a power source 52 (refer to FIG. 7) so that a predetermined direct current (DC) and/or a predetermined alternating current (AC) can be supplied to the primary transfer rollers 11C, 11M, 11Y, and 11K.

Further, a secondary transfer roller 12 that serves as a secondary transfer member is disposed facing the drive roller 9 with the intermediate transfer belt 8 interposed therebetween. The secondary transfer roller 12 presses an outer surface of the intermediate transfer belt 8 at which the secondary transfer roller 12 faces the drive roller 9 to form a secondary nip contact area therebetween. Similar to the primary transfer rollers 11C, 11M, 11Y, and 11K, the secondary transfer roller 12 is connected to a power source so that a predetermined direct current (DC) and/or a predetermined alternating current (AC) can be supplied to the secondary transfer roller 12.

Further, a belt cleaning unit 13 is disposed at a right-hand side of the image forming apparatus 100 in FIG. 3, facing the outer surface of the intermediate transfer belt 8 so as to clean the outer surface of the intermediate transfer belt 8. The belt cleaning unit 13 includes a waste toner transport hose. The waste toner transport hose extends from the belt cleaning unit 13 and is connected to an entrance of a waste toner container 14 that is disposed below the transfer device 7.

The sheet feeder 15 is disposed below the main body 100*a* of the image forming apparatus 100 to convey a sheet S such as paper and OHP (overhead projector) sheet to the secondary nip contact area. The sheet feeder 15 includes a sheet feed tray 16, a sheet feed roller 17, a friction pad 18, a pair of registration rollers 19, a registration feeler 20, and a sheet detection sensor 21.

The sheet feed tray 16 serves as a sheet container to accommodate multiple sheets S therein.

The sheet feed roller 17 serves as a sheet feeding unit to feed and convey the sheets S accommodated in the sheet feed tray 16.

The friction pad 18 serves as a separation unit to separate the sheet S one by one as each sheet S passes between the sheet feed roller 17 and the friction pad 18.

The pair of registration rollers 19 serves as a sheet conveying unit to correct skew of the sheet S fed by the sheet feed roller 17 and convey the sheet S further forward.

The registration feeler 20 serves as a detector to detect the sheet S that is fed and conveyed.

The sheet detection sensor 21 detects whether or not the sheet S is stored in the sheet feed tray 16. Specifically, the sheet detection sensor 21 can detect a state in which all the sheet S is used and no sheet S is left in the sheet feed tray 16, and a state in which the sheet feed tray 16 is inserted into or removed from the image forming apparatus 100.

The sheet feed tray 16 is integrally mounted with the friction pad 18 and a reentry sheet conveyance pathway 31 of a duplex conveyance portion 28 so as to be removed together in a right-hand side in FIG. 3.

Further, a fixing unit 22 is disposed downstream from the secondary nip contact area in a sheet conveyance direction, which equals to an upper part of FIG. 3, to fix an image onto the sheet S. The fixing unit 22 includes a fixing roller 23, a pressure roller 24, and so forth. The fixing roller 23 serves as a fixing member to be heated by a heat source. The pressure roller 24 serves as a pressing member to press the fixing roller 23 to form a fixing nip contact area therebetween.

Further, a sheet discharging unit 25 is disposed at an upper portion of the main body 100*a* of the image forming apparatus 100. The sheet discharging unit 25 includes a pair of sheet discharging rollers 26 and a sheet discharging tray 27. The pair of sheet discharging rollers 26 discharges the sheet S conveyed from the fixing unit 22 outside of the main body 100*a*. The sheet discharging tray 27 stacks the discharged sheet S therein.

Further, a duplex conveyance portion 28 is provided on the right-hand side of the main body 100*a* of the image forming apparatus 100 in FIG. 3 to convey the sheet S for duplex printing. The duplex conveyance portion 28 includes a duplex conveyance pathway 29, a separator 30 to guide the sheet S to the duplex conveyance pathway 29, and a reentry pathway 31 through which the sheet S that has passed through the duplex conveyance pathway 29 is conveyed to an upstream side from the pair of registration rollers 19 in the sheet conveyance direction. Further, a feeler 32 for detecting the sheet S is disposed in a vicinity of an upstream side of the separator 30 in the sheet conveyance direction.

Next, a description is given of a basic operation of the image forming apparatus 100 illustrated in FIG. 3.

As an image forming operation starts, the photoconductors 2C, 2M, 2Y, and 2K provided in the process units 1C, 1M, 1Y, and 1K are driven to rotate in a clockwise direction in FIG. 3 so that the charging rollers 3C, 3M, 3Y, and 3K uniformly charge the respective surfaces of the photoconductors 2C, 2M, 2Y, and 2K to a predetermined polarity. Based on the image data of a document that is read by an image reading device, the optical writing device 6 emits the laser light beams L1, L2, L3, and L4 to irradiate the charged surfaces of the photoconductors 2C, 2M, 2Y, and 2K so as to form respective electrostatic latent images on the surfaces of the photoconductors 2C, 2M, 2Y, and 2K. At this time, the image data for each of the photoconductors 2C, 2M, 2Y, and 2K is for a single color image data of cyan, magenta, yellow, and black after color separation of a desired (preferred) full-color image data. Then, the developing rollers 4C, 4M, 4Y, and 4K supply respective toners to the electrostatic latent images formed on the surfaces of the photoconductors 2C, 2M, 2Y, and 2K, thereby developing the electrostatic latent images into respective visible toner images.

Then, the drive roller 9 that extends the intermediate transfer belt 8 is rotated to rotate the intermediate transfer belt 8 in the direction B. Further, by applying a constant voltage that has a polarity opposite a toner charge polarity or a voltage that is done with a constant current control, a transfer electrical field is generated in each of the primary nip contact areas formed between the primary transfer rollers 11C, 11M, 11Y, and 11K and the corresponding photoconductors 2C, 2M, 2Y, and 2K. Then, the transfer electrical fields cause the single color toner images formed on the respective surfaces of the photoconductors 2C, 2M, 2Y, and 2K to be transferred sequentially onto the surface of the intermediate transfer belt 8 in an overlaid manner. Consequently, the intermediate transfer belt 8 carries a full-color toner image on the surface thereof Further, residual toner remaining on the surfaces of the photoconductors 2C, 2M, 2Y, and 2K without being transferred onto the intermediate transfer belt 8 is removed by the cleaning blades 5C, 5M, 5Y, and 5K.

Then, as the image forming operation starts, the sheet feed roller 17 rotates to hold the sheet S contained in the sheet feed tray 16 between the sheet feed roller 17 and the friction pad 18 to be separated one by one and conveyed to the pair of registration rollers 19. The thus-conveyed sheet S is abutted against the pair of registration rollers 19 that remains unrotated there to form a predetermined amount of deflection, thereby correcting skew of the sheet S. Thereafter, the pair of registration rollers 19 starts to drive at a predetermined timing, in synchronization of the image transferred onto the intermediate transfer belt 8 reaching the secondary nip contact area, the sheet S is conveyed to the secondary nip contact area. At this time, the transfer voltage that has a polarity opposite the toner charge polarity of the toner image formed on the intermediate transfer belt 8 is applied to the secondary transfer roller 12, and therefore a transfer electrical field in the secondary nip contact area. The transfer electrical field generated on the secondary nip contact area transfers the toner image formed on the intermediate transfer belt 8 onto the sheet S at one time.

Further, residual toner remaining on the intermediate transfer belt 8 without being transferred onto the sheet S is removed by the belt cleaning unit 13 and then collected by the waste toner container 14.

Then, the sheet S is conveyed to the fixing unit 22 so that the toner image on the sheet S is fixed to the sheet S by application of heat by the fixing roller 23 and pressure by the pressure roller 24. The sheet S is eventually discharged by the pair of discharging rollers 26 onto the sheet discharging tray 27.

Further, for duplex printing, after the toner image is transferred and fixed to a front side (one side) of the sheet S, when the trailing edge of the sheet S has passed by the separator 30, the pair of sheet discharging rollers 26 is rotated in reverse to switch the trailing and leading edges of the sheet S and convey the sheet S to the duplex conveyance pathway 29. The sheet S then passes the reentry pathway 31 to the pair of registration rollers 19 again. Thereafter, same as transfer and fixing of the toner image onto the front side of the sheet S, a different toner image is transferred and fixed onto a back side of the sheet S, and the sheet S is then discharged to the sheet discharging tray 27.

The above description shows an image forming operation for forming a full-color image on a sheet. However, the operation of the process units 1C, 1M, 1Y, and 1K of the image forming apparatus 100 according to the present invention is not limited thereto. For example, any one of the four process units 1C, 1M, 1Y, and 1K can be used to form a single color image, or two or three of the process units 1C, 1M, 1Y, and 1K can be used to form a color image of two or three colors.

Figure 4:
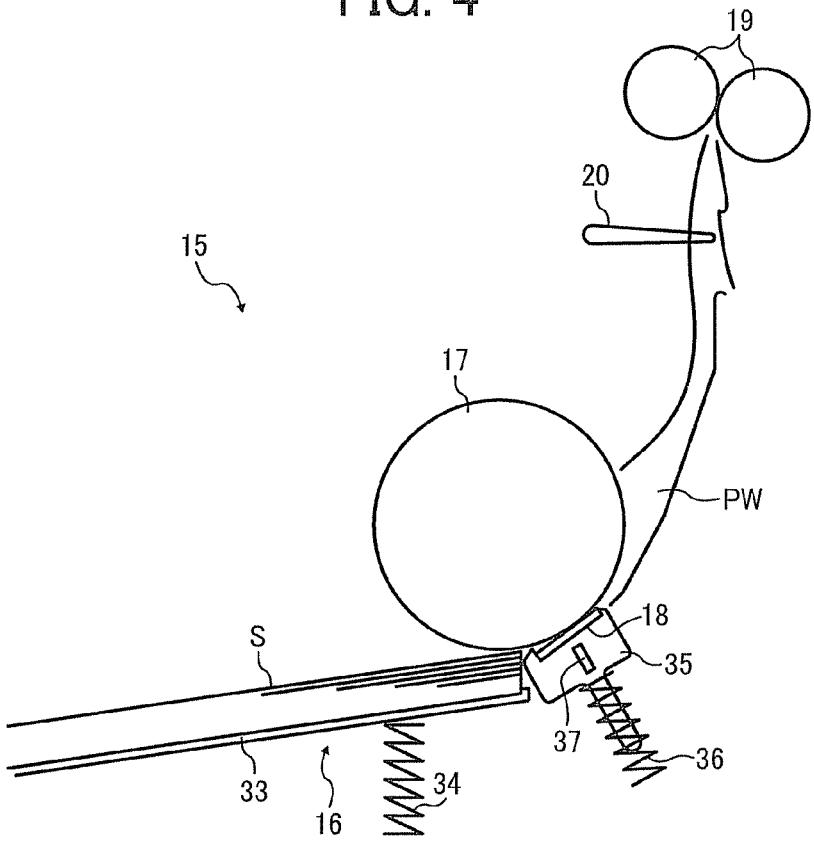
FIG. 4 is a cross-sectional view of the sheet feeder illustrated in FIG. 3.
Figure 5:
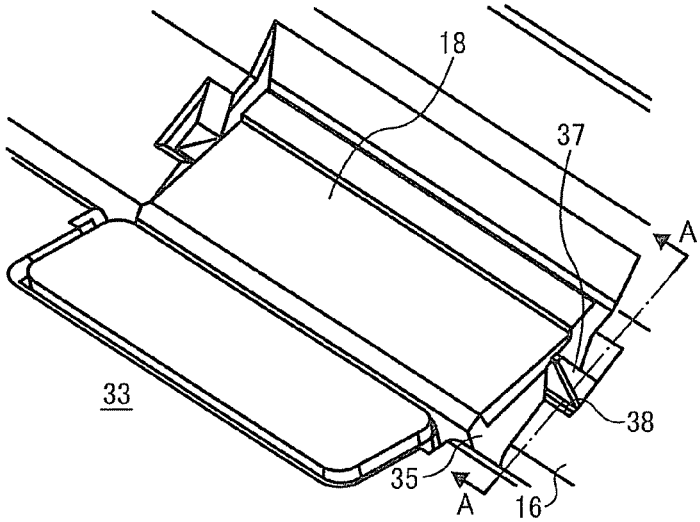
FIG. 5 is a perspective view of a friction pad of the sheet feeder of FIG. 4 and components disposed around the friction pad.
Figure 6:
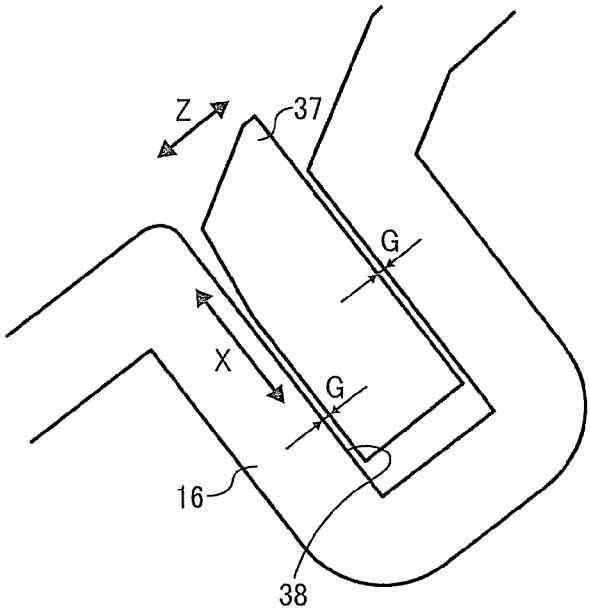
FIG. 6 is a cross-sectional view taken as indicated by line A-A line in FIG. 5.

Next, a detailed description is given of the sheet feeder 15 in reference to FIGS. 4 through 6.

As illustrated in FIG. 4, the sheet feeder 15 further includes a base plate 33, a base plate pressure spring 34, a holder 35, and a friction pad pressure spring 36.

The base plate 33 is mounted on the sheet feed tray 16 and has a right end in FIG. 4 to swing upward and downward about a rotary shaft disposed at a left end thereof in FIG. 4.

The base plate pressure spring 34 serves as a biasing member to press the base plate 33 upward. According to this action of the base plate pressing spring 34, an uppermost sheet of the sheets S constantly contacts the sheet feed roller 17 regardless of the number of sheets contained therein.

The friction pad 18 is supported or held with the holder 35 that moves in a direction toward or away from the sheet feed roller 17.

Further, the friction pad pressure spring 36 serves as a biasing member to press the holder 35 upward to the sheet feed roller 17. This action can apply a constant friction force to the sheet S when the sheet feed roller 17 is rotated to feed the sheet S to the friction pad 18. Further, even when two sheets S are fed to a contact portion or a nip contact area formed between the sheet feed roller 17 and the friction pad 18, the friction force can separate multiple sheets S one by one.

FIG. 5 is a perspective view of the friction pad 18 of the sheet feeder 15 of FIG. 4 and components disposed around the friction pad. FIG. 6 is a cross sectional view taken as indicated by line A-A line in FIG. 5. As illustrated in FIGS. 5 and 6, a positioning unit 37 is mounted on the holder 35 that holds the friction pad 18. The positioning unit 37 is inserted into a groove 38 that is disposed on the sheet feed tray 16. By slidably moving the positioning unit 37 along the groove 38, the holder 35 can move in the sheet conveyance direction and a substantially vertical direction (i.e., in a direction indicated by arrow X in FIG. 6).

By contrast, movement of the holder 35 in the sheet conveyance direction (i.e., a direction indicated by arrow Z in FIG. 4) is limited due to interference between the positioning unit 37 and the groove 38. Even so, a small gap G is provided between the positioning unit 37 and the groove 38. Backlash is provided in the sheet conveyance direction so that sliding ability in the sheet conveyance direction and the substantially vertical direction of the positioning unit 37 can be obtained.

The registration feeler 20 as illustrated in FIG. 4 detects the leading edge of the sheet S passing through a sheet conveyance pathway PW extending between the sheet feed roller 17 and the pair of registration rollers 19. Specifically, when the sheet S conveyed by the sheet fed roller 17 contacts the registration roller 20, the leading edge of the registration feeler 20 pivots, blocking light beam emitted from a through-beam sensor (a registration sensor), thereby detecting the leading of the sheet S.

Figure 7:
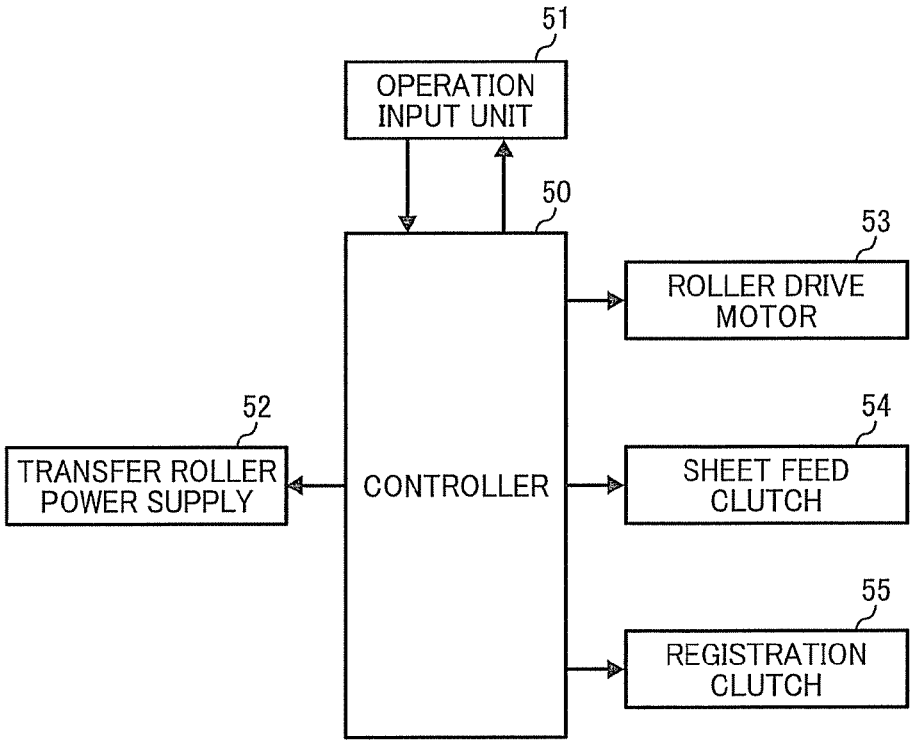
FIG. 7 is a block diagram of a controller of the image forming apparatus of FIG. 3.

Further, the sheet feed roller 17 and the pair of registration rollers 19 are driven by a common drive source (a roller drive motor 53, see FIG. 7) and include respective clutches (i.e., a sheet feed clutch 54 for the sheet feed roller 17 and a registration clutch 55 for the pair of registration rollers 19, see FIG. 7) to optionally determine when the drive is turned on or off.

FIG. 7 is a block diagram illustrating a configuration of a controller 50 provided to the image forming apparatus 100 according to an example embodiment of the present patent application.

As illustrated in FIG. 7, the controller 50 is formed of a microcomputer that includes a central processing unit (CPU), a read-only memory (ROM), a random access memory (RAM), an input and output (I/O) interface, and the like.

The controller 50 shown in FIG. 7 is connected to an operation input unit 51, a transfer roller power source 52, a roller drive motor 53, a sheet feed clutch 54, a registration clutch 55, and other various sensors and motors provided to the image forming apparatus 100.

The controller 50 controls operations of the transfer roller power source 52, the roller motor 53, the sheet feed clutch 54, and the registration clutch 55 according to signals inputted from the operation input unit 51 and so forth, thereby causing the sheet feeder 15 to perform sheet feeding operation and sheet conveyance operation.

The operation input unit 51 is provided in the image forming apparatus 100 and includes various keypads such as a numeric keypad and a print start keypad, and various indicators. A user inputs sheet information such as material and size of a sheet directly or selects the sheet information via selection buttons through the operation input unit 101 when feeding the sheet by the sheet feeder 15. The sheet information inputted or selected by the user is converted to a signal and is outputted to the controller 50.

The transfer roller power source 52 supplies a predetermined direct current (DC) and/or a predetermined alternating current (AC) to the primary transfer rollers 11C, 11M, 11Y, and 11K and the secondary transfer roller 12.

The roller drive motor 53 rotates the sheet feed roller 17 and the pair of registration rollers 19 included in the sheet feeder 15 according to the input signal from the controller 50.

The sheet feed clutch 54 is disposed between the roller drive motor 53 and the sheet feed roller 17 and switches between opening (transmission) and closing (blocking) the power source between the roller drive motor 53 and the sheet feed roller 17 according to the input signal from the controller 50.

The registration clutch 55 is disposed between the roller drive motor 53 and the pair of registration rollers 19 and switches between opening (transmission) and closing (blocking) the power source between the roller drive motor 53 and the pair of registration rollers 19 according to the input signal from the controller 50.

Figure 8:
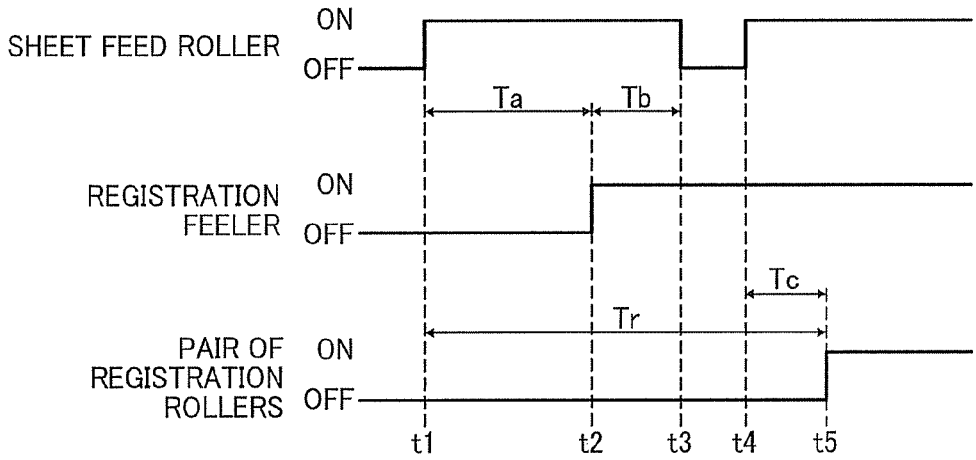
FIG. 8 is a diagram showing a timing chart of the driving of a feed roller and the driving of a pair of registration rollers.

Referring to a timing chart illustrated in FIG. 8, a description is given of respective points in time at which the sheet feed roller 17 and the pair of registration rollers 19 are driven or stopped.

Figure 9:
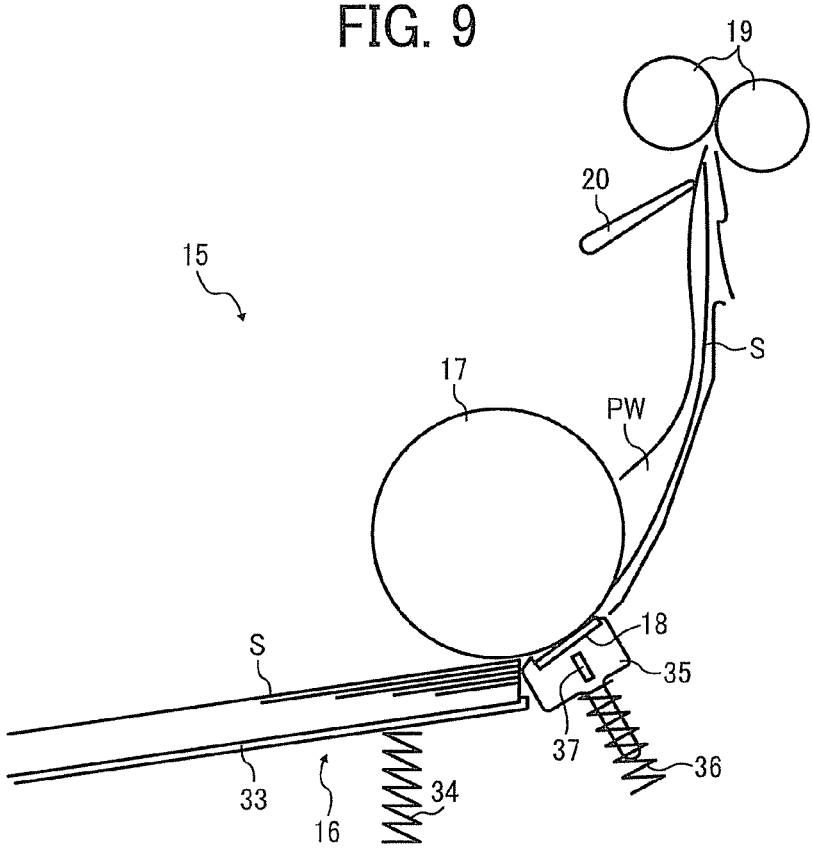
FIG. 9 is a diagram illustrating a state in which a sheet is stopped before abutting against a registration roller.

As illustrated in the timing chart of FIG. 8, the sheet feed roller 17 is started to rotate at a point in time t1 to feed the sheet S toward the pair of registration rollers 19. After the registration feeler 20 detects the sheet S that is being conveyed through the sheet conveyance pathway PW at a point in time t2, the sheet feed roller 17 is stopped temporarily when the leading edge of the sheet S reaches the pair of registration rollers 19 at a point in time t3 (refer to FIG. 9). Thereafter, the sheet feed roller 17 is started to rotate again at a point in time t4 to form a deflection or flexure of the sheet S by abutting the leading edge of the sheet S against the pair of registration rollers 19. Then, while the sheet feed roller 17 is rotating, the pair of registration rollers 19 is started to rotate at a point in time t5 so that the sheet S is conveyed further forward.

As described above, even after the deflection of the sheet S has been formed, the sheet feed roller 17 rotates continuously, so as to prevent the sheet feed roller 17 from rotating in reverse due to a restorative force of the sheet S. That is, while the sheet P is being deflected, the restorative force caused by the deflection remains. At this time, however, the driving force is transmitted to the sheet feed roller 17, thereby preventing the sheet feed roller 17 from rotating in reverse. By so doing, the friction pad is not affected by the restorative force caused by the deflection of the sheet S (i.e., a force toward an upstream side in the sheet conveyance direction). Consequently, even if there is a backlash between the positioning unit 37 and the groove 38 (See FIG. 6), it is possible to prevent occurrence of impact noise caused by abutment of the positioning unit 37 against the groove 38.

It is to be noted that, in FIG. 8, a period Tr starting when the rotation of the sheet feed roller 17 is initially started and ending when the pair of registration rollers 19 starts to rotate is substantially the same in the conventional control process, and therefore there is no decrease the number of conveyances of sheets S per unit of time compared to the conventional control process.

However, as described above, in the control process in which the sheet S is temporarily stopped before the sheet contacts the pair of registration rollers 19, if the sheet S slips before its conveyance, it is likely that the position at which the sheet S stops before the pair of registration rollers 19 varies. Specifically, with occurrence of slippage of the sheet S, the distance the sheet S is conveyed by the sheet feed roller 17 in a period between the point in time t1 and the point in time t3 and a period between the point in time t4 and the point in time t5, as illustrated in FIG. 8, changes.

Therefore, in Embodiment 1, the controller 50 estimates an amount of slip at a period Ta between the point in time t1 at which the controller 50 starts to feed the sheet S and the point in time t2 at which the registration feeler 20 detects the sheet S. Then, based on the estimated amount of slip, the controller 50 corrects a period Tb between the point in time t2 and the point in time t3 at which the controller 50 stops the driving of the sheet feed roller 17 temporarily and a period Tc between the point in time t4 at which the controller 50 resumes rotation the sheet feed roller 17 and the point in time t5 at which the controller 50 starts the driving of the pair of registration rollers 19. With these corrections, the controller 50 can change or adjust the point in time t3 to temporarily stop the sheet feed roller 17 properly before the leading edge of the sheet S abuts against the pair of registration rollers 19 and the point in time t4 to resume the driving of the sheet feed roller 17 accurately. The point in time t3 corresponds to and is hereinafter also referred to as a "temporary stop point in time" and the point in time t4 corresponds to and is hereinafter also referred to as a "driving resume point in time".

Regardless of correction values, the point in time t5 at which the controller 50 starts to rotate the pair of registration rollers 19 is not changed. Consequently, a period Tr between when the controller 50 initially starts the driving of the sheet feed roller 17 and when the controller 50 starts the driving of the pair of registration rollers 19 does not vary, and therefore the number of conveyance of sheets per unit time is not reduced and may process the same number.

The following equations 1 through 3 are used for the corrections of the period Tb and the period Tc:

$$k=t0/R0 \quad \text{Equation 1;}$$

$$Tb=k\times R1 \quad \text{Equation 2; and}$$

$$Tc=k\times R2 \quad \text{Equation 3.}$$

In Equation 1, "k" represents a correction coefficient, "t0" represents the actual length of time of the period Ta, and "R0" represents a calculated length of time, which is in other words an estimated length of time. That is, the actual length of time "t0" corresponds to an actual period of time from when the sheet S departs a predetermined standby position where the sheet S stays put before being fed forward to when the sheet S passes a detection position where the registration feeler 20 detects the passage of the sheet S, the estimated length of time "R0" corresponds to a calculated or estimated period of time from when the sheet S should travel from the predetermined standby position to the detection position without slipping, and the correction coefficient "k" is an estimated value indicated by a slip ratio of a comparison of the actual length of time t0 and the estimated length of time R0.

Further, "R1" in Equation 2 represents a calculated or estimated length of time of the period Tb when it is assumed that no slip occurs, and "R2" in Equation 3 represents a calculated or estimated length of time of the period Tc when it is assumed that no slip occurs. As indicated in Equations 2 and 3, the periods Tb and Tc are corrected by multiplying the estimated length of times R1 and R2, respectively, by the correction coefficient k obtained by Equation 1.

Figure 10:
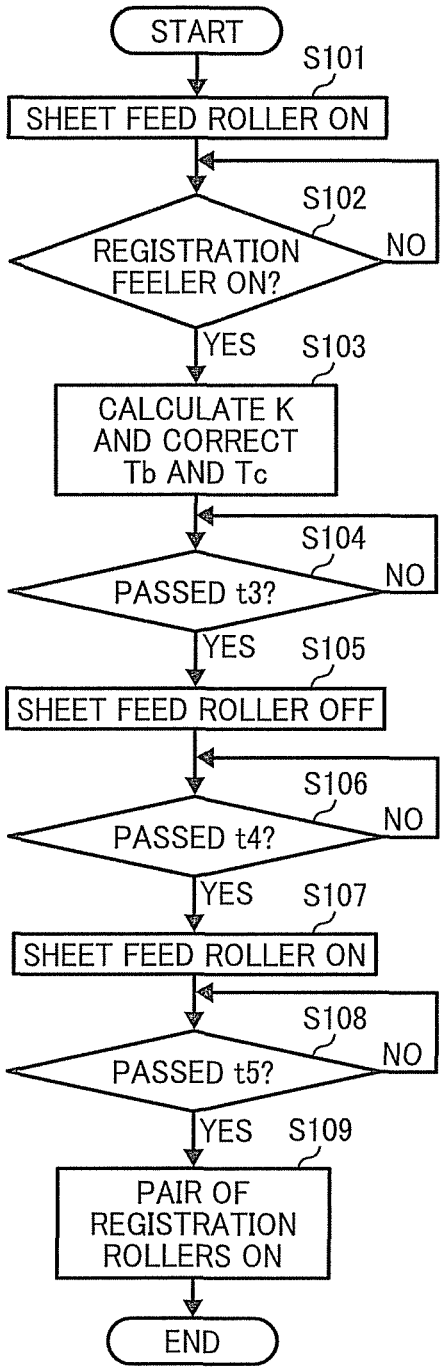
FIG. 10 is a flowchart showing a correction control process of driving periods of the sheet feed roller and the pair of registration rollers.

Referring to a flowchart illustrated in FIG. 10, a description is given of a correction control process of the driving periods of the sheet feed roller 17 and the pair of registration rollers 19 in Embodiment 1.

As illustrated in FIG. 10, the controller 50 drives the sheet feed roller 17 to rotate to feed the sheet S in step S101, and then the controller 50 determines whether or not the registration feeler 20 is turned on in step S102.

When the registration feeler 20 is not turned on, the result of step S102 is NO, and the controller 50 repeats the procedure until the registration feeler 20 is turned on.

When the registration feeler 20 is turned on, the result of step S102 is YES, and the process proceeds to step S103. With the registration feeler 20 turned on, the controller 50 can estimate an actual period of passage of the sheet S.

In step S103, the controller 50 calculates the correction coefficient k according to the ratio of the actual length of time t0 with respect to the estimated length of time R0, and corrects the period Tb and the period Tc based on the thus-obtained correction coefficient k.

Thereafter, the controller 50 determines whether or not the control process has passed the point in time t3 (as illustrated in FIG. 8) in step S104.

When the control process has not passed the point in time t3, the result of step S104 is NO, and the controller 50 repeats the procedure until the control process passes the point in time t3.

When the control process has passed the point in time t3, the result of step S104 is YES, and the controller 50 turns off the driving of the sheet feed roller 17 in step S105. With this action, the sheet S is stopped before the pair of registration rollers 19. Here, the point in time t3 corresponds to the time determined according to the corrected period Tb.

Then, in step S106, the controller 50 determines whether or not the control process has passed the point in time t4 (as illustrated in FIG. 8).

When the control process has not passed the point in time t4, the result of step S106 is NO, and the controller 50 repeats the procedure until the control process passes the point in time t4.

When the control process has passed the point in time t4, the result of step S106 is YES, and the controller 50 turns on the driving of the sheet feed roller 17 in step S107. With this action, the sheet S abuts against the pair of registration rollers 19 to form a deflection. Here, the point in time t4 corresponds to the time determined according to the corrected period Tc.

Thereafter, the controller 50 determines whether or not the control process has passed the point in time t5 (as illustrated in FIG. 8) in step S108.

When the control process has not passed the point in time t5, the result of step S108 is NO, and the controller 50 repeats the procedure until the control process passes the point in time t5.

When the control process has passed the point in time t5, the result of step S108 is YES, and the controller 50 turns on the driving of the pair of registration rollers 19 in step S109. With this action, the sheet S is further forwarded.

As described above, the correction coefficient k is calculated to correct the periods Tb and Tc of the sheet feed roller 17 based on the correction coefficient k. By so doing, the position of the sheet S is adjusted for the possibility of sheet slipping. However, when the correction coefficient k increases significantly due to an unexpectedly abrupt slip, if the periods Tb and Tc are corrected based on this correction coefficient k, the amount of deflection of the sheet S may increase significantly to deflect the sheet S or get the sheet S jammed. Further, due to the increase in the amount of deflection of the sheet S, the sheet S can abut against a guide plate to generate impact noise. Further, when the deflection of the sheet S cannot be retracted in the sheet conveyance pathway PW, the leading edge of the sheet S may be conveyed beyond a nip contact area of the pair of registration rollers 19.

In order to prevent the above-described problems, an upper limit kmax is set to the correction coefficient k. When the correction coefficient k exceeds the upper limit kmax, it is preferable that the periods Tb and Tc are corrected with the upper limit kmax. The upper limit kmax can be set, for example, to a value with which the sheet S cannot cause paper jam. Specifically, the upper limit kmax is preferably set to $k \leqq 2$, and more preferably set to $k \leqq 1.5$.

By contrast, when the correction coefficient k decreases significantly, if the periods Tb and Tc are corrected based on this correction coefficient k, the amount of deflection of the sheet S may decrease significantly. Consequently, skew of the sheet S cannot be corrected or the leading edge of the sheet S does not reach the pair of registration rollers 19 when the pair of registration rollers 19 are started to rotate. The correction coefficient k can be reduced significantly when a preceding sheet S1 is conveyed, for example, a subsequent sheet S2 is conveyed together with the preceding sheet S1 and the subsequent sheet S2 is fed from a position that is located downstream from the predetermined standby position. In order to prevent this problem, a lower limit kmin is set to the correction coefficient k. When the correction coefficient k is below the lower limit kmin, it is preferably that the periods Tb and Tc are corrected with the lower limit kmin. The lower limit kmin is preferably set to $1 \leqq K$, for example.

Further, when the conveyance speed of the sheet S is set to be changeable in accordance with desired image quality, the ratio of slip of the sheet S varies based on the conveyance speed. Therefore, when the feed speed of the sheet S changes, the periods Tb and Tc are determined based on the correction coefficient k and the feed speed of the sheet S. By so doing, the accuracy of position of the sheet S is enhanced, and stable skew correction can be performed.

Here, when a correction coefficient based on the feed speed of the sheet S is represented as "kv", the periods Tb and Tc can be obtained according to the following equations. The estimated length of times "R1" and "R2", and the correction coefficient "k" are same as used in Equations 1 through 3:

$$Tb=k\times R1\times kv \qquad \text{Equation 4; and}$$

$$Tc=k\times R2\times kv \qquad \text{Equation 5.}$$

Further, because various types of sheets are used, the thickness, rigidity, coefficient of friction, and so forth can and does vary accordingly, and therefore the appropriate amount of deflection varies depending on the type. Therefore, in order to obtain the appropriate amount of deflection for each of multiple different sheets, it is necessary to change the value of period Tc for aiming the deflection according to the types of the sheet S. Consequently, the period Tc is adjusted to obtain an appropriate amount of deflection for each of different types of sheets. For example, if the value of the period Tc is equal to ΔR2, the period Tc can be corrected with the following equation, Equation 6:

$$Tc=k\,(R2+\Delta R2) \qquad \text{Equation 6.}$$

With this adjustment, even if different types of sheets are used, the appropriate amount of deflection can be provided, and therefore the skew of the sheet can be corrected reliably. The estimated length of time "R2" and the correction coefficient "k" are same as used in Equations 1 through 5.

Further, with Equation 7, which is a combination of Equations 5 and 6, the skew correction can be performed according to both the type of sheet used and the feed speed of the sheets S:

$$Tc=k\,(R2+\Delta R2)\times kv \qquad \text{Equation 7.}$$

Further, in the sheet feeder 15 according to Embodiment 1, the standby position of a first sheet to be fed after the sheet S is supplied to the sheet feed tray 16 and the standby position of a second (and subsequent) sheet are different. Specifically, as illustrated in FIG. 4, the first sheet stands by at a position where the leading edge thereof is located upstream from and close to the contact portion of the sheet feed roller 17 and the friction pad 18. However, the second (and subsequent) sheet is fed together with the first (or preceding) sheet, and therefore the leading edge of the second (or subsequent) sheet is located downstream from the contact portion of the sheet feed roller 17 and the friction pad 18.

As described above, the standby positions of the first sheet and the second (or subsequent) sheet are different, and therefore the estimated length of time R0 from when the sheet leaves the standby position to when the sheet S passes the detection position of the registration feeler 20 can vary. Consequently, when the sheet is fed from a position different from the predetermined standby position determined prior to sheet conveyance, the estimated length of time R0 needs to be modified according to the actual position from which the sheet is actually fed. In this embodiment 3, the standby position of the second (or subsequent) sheet is regarded as the predetermined standby position (the reference standby position). Therefore, when the first sheet is fed, the estimated length of time of the first sheet is set to be greater than the estimated length of time of the second sheet. With this setting, regardless of the standby position of the sheet, the sheet can be reliably positioned accurately.

The leading edges of sheets accommodated in the sheet feed tray 16 are aligned after the sheet feed tray 16 is removed from and then inserted into the main body of the image forming apparatus 100. Therefore, after the sheet detection sensor 21 illustrated in FIG. 3 detects movement (removal and insertion) of the sheet feed tray 16, the controller 50 may adjust the standby position of the first sheet using the estimated length of time R0 that is different from the second (or subsequent) sheet.

[Embodiment 2]

Figure 11:
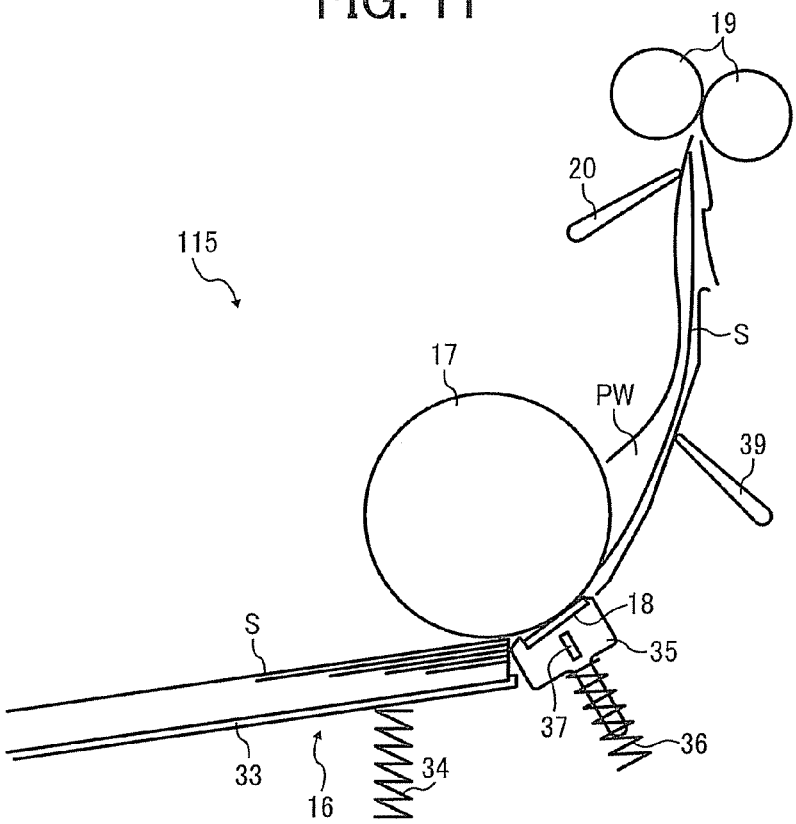
FIG. 11 is a cross sectional view of a sheet feeder according to Embodiment 2 of the present invention.

FIG. 11 is a cross-sectional view illustrating a schematic configuration of a sheet feeder 115 according to Embodiment 2 of the present invention.

Elements and components of the sheet feeder 115 in Embodiment 2 illustrated in FIG. 11 is similar to the sheet feeder 15 illustrated in FIG. 4, except that the sheet feeder 115 further includes a sheet feed feeler 39. The sheet feed feeler 39 is disposed upstream from the registration feeler 20 in the sheet conveyance direction to serve as a detector to detect the leading edge of a sheet S. The sheet feed feeler 39 has the same structure and functions as the registration feeler 20.

Figure 12:
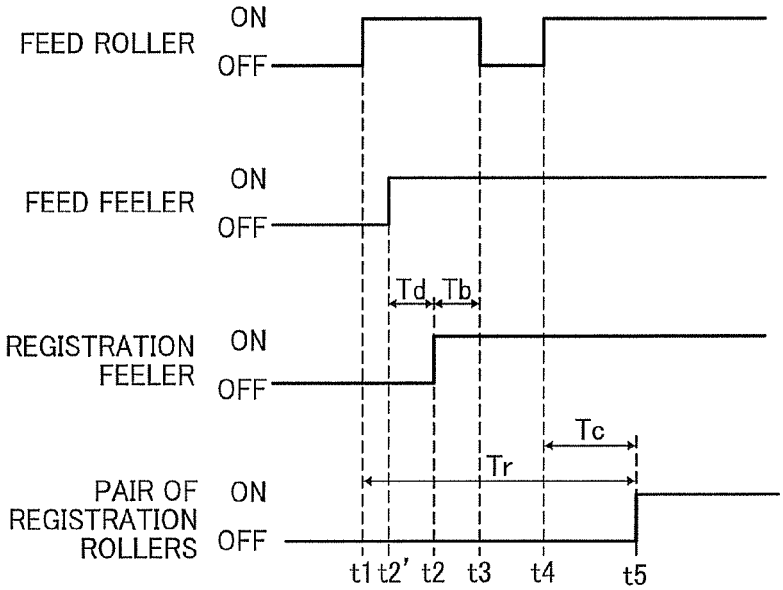
FIG. 12 is a diagram showing a timing chart of the driving of the feed roller and the driving of the pair of registration rollers.

Referring to a timing chart illustrated in FIG. 12, a description is given of respective points in time at which the sheet feed roller 17 and the pair of registration rollers 19 of the sheet feeder 115 in this embodiment are driven or stopped.

As illustrated in the timing chart of FIG. 12, the sheet feed roller 17 is started at a point in time ti to feed the sheet S toward the pair of registration rollers 19. After a point in time t2' at which the sheet feed feeler 39 serving as a first detector detects the sheet S that is being conveyed through the sheet conveyance pathway PW, the registration feeler 20 serving as a second detector then detects the sheet S at a point in time t2. Then, the sheet feed roller 17 is stopped temporarily at a point in time t3 at which the leading edge of the sheet S reaches the pair of registration rollers 19. Thereafter, the sheet feed roller 17 is started again at a point in time t4 to form a deflection or flexure by abutting the leading edge of the sheet S against the pair of registration rollers 19. Then, while driving the sheet feed roller 17, the pair of registration rollers 19 is started at a point in time t5 to convey the sheet S.

As described above, similar to Embodiment 1, even after the deflection has been formed, the sheet feed roller 17 of Embodiment 2 is rotated continuously. Consequently, even if there is backlash between the positioning unit 37 and the groove 38 (See FIG. 6), it is possible to prevent occurrence of impact noise caused by abutment of the positioning unit 37 against the groove 38.

It is to be noted that, in FIG. 12, the period Tr starting when the rotation of the sheet feed roller 17 is initially started and ending when the pair of registration rollers 19 starts to rotate is substantially the same in the conventional control process, and therefore there is no decrease the number of conveyances of sheets S per unit of time compared to the conventional control process.

Further, similar to Embodiment 1, based on the amount of slip calculated and estimated when the sheet S is fed, the controller 50 corrects the period Tb from the point in time t2 at which the registration feeler 20 detects the sheet S to the point in time t3 at which the controller 50 stops the driving of the sheet feed roller 17 temporarily and the period Tc from the point in time t4 at which the controller 50 resumes rotation of the sheet feed roller 17 to the point in time t5 at which the controller 50 starts the driving of the pair of registration rollers 19. However, different from Embodiment 1, the amount of slip of the sheet S is estimated for a period Td from the point in time t2' at which the sheet feed feeler 38 detects the sheet S to the point in time t2 at which the registration feeler 20 detects the sheet S.

In Embodiment 1 illustrated in FIG. 4, the amount of slippage of the sheet S is estimated by calculating a period from when the sheet S leaves the standby position to when the sheet S passes the registration feller 20. Therefore, if the standby position of each sheet S varies, the amount of slip may be inaccurate.

By contrast, in Embodiment 2 illustrated in FIG. 11, the amount of slippage of the sheet S is estimated by calculating a period in which the sheet S passes between the sheet feed feeler 38 and the registration feeler 20. Therefore, the amount of slippage of the sheet S can be estimated regardless of variation of the standby positions of the sheet. S. Consequently, the estimated amount of slippage of the sheet S can be more reliable, and the position of the sheet S can be reliably positioned more accurately.

The correction in Embodiment 2 can be performed basically similarly to Embodiment 1, except that "t0" in Equation 1 corresponds to the actual length of time (the period Td illustrated in FIG. 3) from when the sheet S leaves the detection position of the sheet feed feeler 38 to when the sheet S passes the detection position of the registration roller and "R0" represents a calculated or estimated length of time of the above-described action.

Further, even in Embodiment 2 as illustrated in FIG. 11, similar to Embodiment 1, the upper limit "kmax" and the lower limit "kmin" of the correction coefficient "k" are set and the types and/or sheet feed speed of the sheet S can be included for correction.

Further, the present invention is not limited to the above-described embodiments and many variations of these are possible without departing from the spirit and scope of the invention.

In the above-described embodiments, the amount of slippage of the sheet S is estimated based on a period of from when the sheet S departs the standby position of the sheet S to when the sheet S passes the registration feeler or of from when the sheet S passes the sheet feed feeler to when the sheet S passes the registration feeler. Two points in time to obtain an estimated amount of slip, however, can be optionally set if the period is from when conveyance of the sheet S is started to when the sheet S is temporarily stopped.

In addition, the image forming apparatus according to the present invention is not limited to a color laser printer as illustrated in FIG. 3 but can be, for example, a printer other than the color laser printer, a copier, a facsimile machine, or a multifunctional image forming apparatus including functions at least two of these functions.

As described above in the embodiments of the present invention, the controller of the image forming apparatus 100 can adjust (correct), according to the amount of slip of the sheet S at sheet feeding, a point in time at which the driving of the sheet feed roller is temporarily stopped before the leading edge of the sheet S abuts against the pair of registration rollers and a point in time at which the driving of the sheet feed roller is resumed. Therefore, the sheet S can be fed and conveyed reliably. Accordingly, even if the sheet S slips at sheet feeding, the stop position and the amount of deflection of the sheet S can be set reliably, thereby correcting the variation of position of the leading edge of the sheet S and skew of the sheet S accurately.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet feeder for an image forming apparatus, comprising:

a sheet container to accommodate a sheet;

a sheet feeding unit to feed the sheet contained in the sheet container;

a sheet conveying unit disposed downstream from the sheet feeding unit in a sheet conveyance direction; and a controller to cause the sheet feeding unit to temporarily stop driving before the leading edge of the sheet that is fed by the sheet feeding unit abuts against the sheet conveying unit, and to cause the sheet feeding unit to restart and rotate continuously while the leading edge of the sheet abuts the sheet conveying unit in a non-driven state, and to cause the sheet conveying unit to start driving while the sheet feeding unit continues to be driven to convey the sheet further forward, the controller varying a temporary stop period to temporarily stop the driving of the sheet feeding unit before the leading edge of the sheet abuts against the sheet conveying unit according to a period in which the sheet passes a first point and a second point between a standby position that is determined prior to feeding of the sheet and a temporary stop position at which the sheet is stopped before the sheet abuts against the sheet conveying unit.

2. The sheet feeder according to claim 1, wherein the controller determines the temporary stop period of the sheet feeding unit according to a correction coefficient that is a ratio of an actual length of time at which the sheet passes the first point and the second point to an estimated length of time at which the sheet passes the first point and the second point.

3. The sheet feeder according to claim 2, wherein, when the correction coefficient is greater than a predetermined upper limit, the controller determines the temporary stop period of the sheet feeding unit based on the upper limit.

4. The sheet feeder according to claim 2, wherein, when the correction coefficient is smaller than a predetermined lower limit, the controller determines the temporary stop period of the sheet feeding unit based on the lower limit.

5. The sheet feeder according to claim 2, wherein the controller determines the temporary stop period of the sheet feeding unit according to the correction coefficient and a sheet feed speed of the sheet feeding unit.

6. The sheet feeding unit according to claim 2, wherein the controller determines a driving resume period of the sheet feeding unit according to the correction coefficient and a sheet type.

7. The sheet feeder according to claim 1, further comprising a detector to detect a leading edge of the sheet on a sheet conveyance pathway defined between the sheet feeding unit and the sheet conveying unit, wherein the first point is a position at which the leading edge of the sheet is located at the standby position prior to the sheet feeding and the second point is a position at which the detector detects the leading edge of the sheet.

8. The sheet feeder according to claim 7, wherein the controller determines the temporary stop period of the sheet feeding unit according to a correction coefficient that indicates a ratio of an actual length of time in which the sheet departs from a standby position prior to the sheet feeding and arrives at a detection position of the leading edge of the sheet, to an estimated length of time in which the sheet departs from the standby position prior to the sheet feeding and arrives at the detection position of the leading edge of the sheet, the controller modifies the estimated length of time according to position when the sheet is fed from a position different from the predetermined standby position prior to the sheet feeding.

9. The sheet feeder according to claim 1, further comprising:

a first detector to detect a leading edge of the sheet on a sheet conveyance pathway defined between the sheet feeding unit and the sheet conveying unit; and a second detector to detect the leading edge of the sheet at a position downstream from the first detector in the sheet conveyance direction on the sheet conveyance pathway, wherein the first point is a position at which the first detector detects the leading edge of the sheet and the second point is a position at which the second detector detects the leading edge of the sheet.

10. An image forming apparatus, comprising:

an image forming device to form an image on an image carrier; and the sheet feeder according to claim 1.

11. A sheet feeder for an image forming apparatus, comprising:

a sheet container to accommodate a sheet;

a sheet feeding unit to feed the sheet contained in the sheet container;

a sheet conveying unit disposed downstream from the sheet feeding unit in a sheet conveyance direction; and a controller to cause the sheet feeding unit to temporarily stop driving before the leading edge of the sheet that is fed by the sheet feeding unit abuts against the sheet conveying unit and to resume the driving to abut the leading edge of the sheet against the sheet conveying unit, and to cause the sheet conveying unit to start driving while the sheet feeding unit is being continuously driven to convey the sheet further forward, the controller varying a temporary stop period to temporarily stop the driving of the sheet feeding unit before the leading edge of the sheet abuts against the sheet conveying unit and a driving resume period to resume the driving of the sheet feeding unit after the temporary stop period, according to a period in which the sheet passes a first point and a second point between a standby position that is determined prior to feeding of the sheet and a temporary stop position that is located before the sheet abuts against the sheet conveying unit.

12. The sheet feeder according to claim 11, wherein the controller determines the temporary stop period of the sheet feeding unit and the driving resume period of the sheet feeding unit according to a correction coefficient that is a ratio of an actual length of time at which the sheet passes the first point and the second point to an estimated length of time at which the sheet passes the first point and the second point.

13. The sheet feeder according to claim 12, wherein, when the correction coefficient is greater than a predetermined upper limit of the correction coefficient, the controller determines the temporary stop period of the sheet feeding unit and the driving resume period of the sheet feeding unit based on the upper limit.

14. The sheet feeder according to claim 12, wherein, when the correction coefficient is smaller than a predetermined lower limit, the controller determines the temporary stop period of the sheet feeding unit and the driving resume period of the sheet feeding unit based on the lower limit.

15. The sheet feeder according to claim 12, wherein the controller determines the temporary stop period of the sheet feeding unit and the driving resume period of the sheet feeding unit according to the correction coefficient and a sheet feed speed of the sheet feeding unit.

16. The sheet feeding unit according to claim 12, wherein the controller determines the driving resume period of the sheet feeding unit according to the correction coefficient and a sheet type.

17. The sheet feeder according to claim 11, further comprising a detector to detect a leading edge of the sheet on a sheet conveyance pathway defined between the sheet feeding unit and the sheet conveying unit, wherein the first point is a position at which the leading edge of the sheet is located at the standby position prior to the sheet feeding and the second point is a position at which the detector detects the leading edge of the sheet.

18. The sheet feeder according to claim 17, wherein the controller determines the temporary stop period of the sheet feeding unit and the driving resume period of the sheet feeding unit according to a correction coefficient that indicates a ratio of an actual length of time in which the sheet departs from a standby position prior to the sheet feeding and arrives at a detection position of the leading edge of the sheet to an estimated length of time in which the sheet departs from a standby position prior to the sheet feeding and arrives at a detection position of the leading edge of the sheet, the controller modifies the estimated length of time according to the position when the sheet is fed from a position different from the predetermined standby position prior to the sheet feeding.

19. The sheet feeder according to claim 11, further comprising:

a first detector to detect a leading edge of the sheet on a sheet conveyance pathway defined between the sheet feeding unit and the sheet conveying unit; and a second detector to detect the leading edge of the sheet at a position downstream from the first detector in the sheet conveyance direction on the sheet conveyance pathway, wherein the first point is a position at which the first detector detects the leading edge of the sheet and the second point is a position at which the second detector detects the leading edge of the sheet.

20. An image forming apparatus, comprising:

an image forming device to form an image on an image carrier; and the sheet feeder according to claim 11.

21. The sheet feeder according to claim 1, further comprising a friction pad in the sheet container, and the friction pad remains unrotated and is biased against the sheet feeding unit.

22. The sheet feeder according to claim 21, further comprising a holder in the sheet container, wherein the holder supports the holder is biased toward the sheet feeding unit.

23. The sheet feeder according to claim 22, further comprising a positioning unit in the holder, the positioning unit being within a groove formed in the sheet container and configured to slidably move along the groove in a direction toward the sheet feeding unit.

24. The sheet feeder according to claim 11, further comprising a friction pad in the sheet container, and the friction pad remains unrotated and is biased against the sheet feeding unit.

25. The sheet feeder according to claim 24, further comprising a holder in the sheet container, wherein the holder supports the holder is biased toward the sheet feeding unit.

26. The sheet feeder according to claim 25, further comprising a positioning unit in the holder, the positioning unit being within a groove formed in the sheet container and configured to slidably move along the groove in a direction toward the sheet feeding unit.

* * * * *